US006100646A

United States Patent [19]

Janczak et al.

[11] Patent Number: 6,100,646

[45] Date of Patent: Aug. 8, 2000

[54] BALLAST FEEDBACK SCHEME

[75] Inventors: Jerzy Janczak, Woodhaven, N.Y.; Adan F. Hernandez, Naperville, Ill.

[73] Assignee: Philips Electronics North America Corporation, New York, N.Y.

[21] Appl. No.: 09/216,265

[22] Filed: Dec. 18, 1998

[51] Int. Cl.[7] ..... H05B 37/02

[52] U.S. Cl. ..... 315/224; 315/244; 315/247; 315/209 R; 315/DIG. 5; 315/DIG. 7

[58] Field of Search ..... 315/224, 209 R, 315/200 R, 247, 244, 219, 226, DIG. 4, DIG. 5, DIG. 7; 363/132

[56] References Cited

U.S. PATENT DOCUMENTS 4,511,823 4/1985 Eaton et al. ..... 315/226

5,404,082 4/1995 Hernandez et al. ..... 315/219

5,982,110 11/1999 Gradzki ..... 315/247

5,994,848 11/1999 Janczak ..... 315/224

*Primary Examiner*—Haissa Philogene

*Attorney, Agent, or Firm*—Edward Blocker; Bernard Franzblau

[57] ABSTRACT

A ballast feedback scheme including a single stage current feedback inverter. To avoid overboosting of the voltage impressed across a buffer capacitor only a portion of the high frequency lamp current is fedback to the buffer capacitor during both ignition and steady state operation of the lamp. Ignition of the lamp is well controlled.

8 Claims, 2 Drawing Sheets

BALLAST FEEDBACK SCHEME

BACKGROUND OF THE INVENTION

This invention relates generally to a feedback scheme for an electronic ballast and, more particularly, to a scheme for minimizing overboost voltage conditions due to feedback.

Conventional ballasts, such as disclosed in U.S. Pat. No. 5,404,082, are smaller and less costly, in part, through elimination of a preconditioner stage. Such ballasts also include an output stage formed from an inverter and a resonant circuit and are commonly referred to as a single stage inverter.

The preconditioner stage following lamp ignition (i.e. during steady state conditions) is often used to increase (i.e. boost) the ballast input voltage in conditioning the voltage applied to the inverter. In the absence of the preconditioner stage, boosting of the ballast input voltage is achieved by supplementing the ballast input voltage with a high frequency signal fedback from the resonant circuit. This high frequency signal represents the resonant inductor current.

The ballast input voltage (typically rectified) and then boosted is applied to a buffer capacitor which serves as a DC source for the inverter. When the high frequency feedback signal is higher than necessary, an overboost voltage is impressed across the buffer capacitor. Under overboost voltage conditions, a very high stress is placed on various ballast components including the buffer capacitor and switches within the inverter. The buffer capacitor is typically of the electrolytic type. The inverter switches are typically power MOSFETs. Both the buffer capacitor and inverter switches can be damaged and fail under overboost voltage conditions.

During lamp ignition, ballast schemes such as disclosed in U.S. Pat. No. 4,511,823, also lead to overboost voltage conditions and are due, in part, to current flowing through the resonant inductor being fedback and charging the buffer capacitor. Complicated control circuitry is required to avoid such overboost resulting in a more costly and more difficult ballast to manufacture.

It is therefore desirable to provide an improved ballast feedback scheme which reduces the high frequency feedback signal in order to avoid overboost voltage conditions during ignition and steady state operation. The scheme should be particularly applicable to an inverter having a single stage with current feedback and high power factor.

SUMMARY OF THE INVENTION

In accordance with a first aspect of the invention, a ballast includes a rectifier, a buffer capacitor coupled across the output of the rectifier and a pair of switches serially connected together having a switch junction therebetween and coupled across the buffer capacitor. The ballast further includes a first serial combination of a resonant inductor and a resonant capacitor which together form a resonant circuit and are coupled between the switch junction and a reference node connecting the buffer capacitor and one of the pair of switches together. A second serial combination of a lamp load and a first reactor are connected in parallel with the resonant capacitor. The ballast also includes a second reactor for splitting current flowing through the lamp load between itself and the first reactor. A feedback path which includes the second additional reactor serves to boost the voltage across the buffer capacitor.

The ballast avoids overboost voltage conditions by providing a feedback path which includes only a portion of the current flowing through the lamp load. In other words, the amount of current being fedback for boosting the voltage across the buffer capacitor is far less than conventional feedback schemes by splitting the current flowing through the lamp load between the first and second reactors. Furthermore and until the lamp is ignited, there is no feedback since there is no lamp current to be fedback, that is, there is no overboosting of the voltage across the buffer capacitor during ignition. Ignition of the lamp therefore can be well controlled. In contrast thereto, conventional feedback schemes can feedback far greater levels of current resulting in overboost voltage condition such as disclosed in U.S. Pat. Nos. 5,404,082 and 4,511,823.

It is a feature of this first aspect of the invention that the level of current flowing through the lamp load is substantially different from the level of current flowing through the resonant inductor. The feedback path can be connected to a junction joining a pair of diodes which are coupled between the buffer capacitor and rectifier. The feedback path further can include a feedback capacitor. This feedback capacitor can be in parallel with one of the diodes.

In accordance with a second aspect of the invention, a method for reducing the voltage applied to a buffer capacitor by a feedback path within a ballast circuit includes the steps of supplying power through a half bridge inverter to a resonant circuit whereby current flows through an inductor of a resonant circuit; and supplying along the feedback path less than all current flowing though a lamp load for charging the buffer capacitor; wherein the lamp load is coupled across a portion of the resonant circuit.

This method reduces the voltage applied to the buffer capacitor by supplying along the feedback path less than all current flowing though a lamp load for charging the buffer capacitor. The level of current being fedback for boosting the voltage across the buffer capacitor is far less than a conventional feedback scheme, that is, only a portion of the lamp load current rather than the entire resonant inductor current is fedback. A substantial reduction in the voltage applied to the buffer capacitor attributable to the feedback current is achieved. Overboost conditions are substantially eliminated.

It is a feature of this second aspect of the invention, that the level of current flowing through the resonant inductor is greater than the level of current flowing through the lamp load.

Accordingly, it is an object of the invention to provide an improved ballast feedback scheme which reduces the high frequency feedback signal in order to avoid overboost voltage conditions during ignition and steady state operation.

It is another object of the invention to provide an improved feedback scheme which is particularly applicable to an inverter having a single stage with current feedback and high power factor.

Still other objects and advantages of the invention will, in part, be obvious and will, in part, be apparent from the specification.

The invention accordingly comprises several steps in the relation of one or more such steps with respect to each of the others, and a device embodying features of construction, combination of elements, and arrangements of parts which are adapted to effect such steps, all is exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENT

Figure 1:
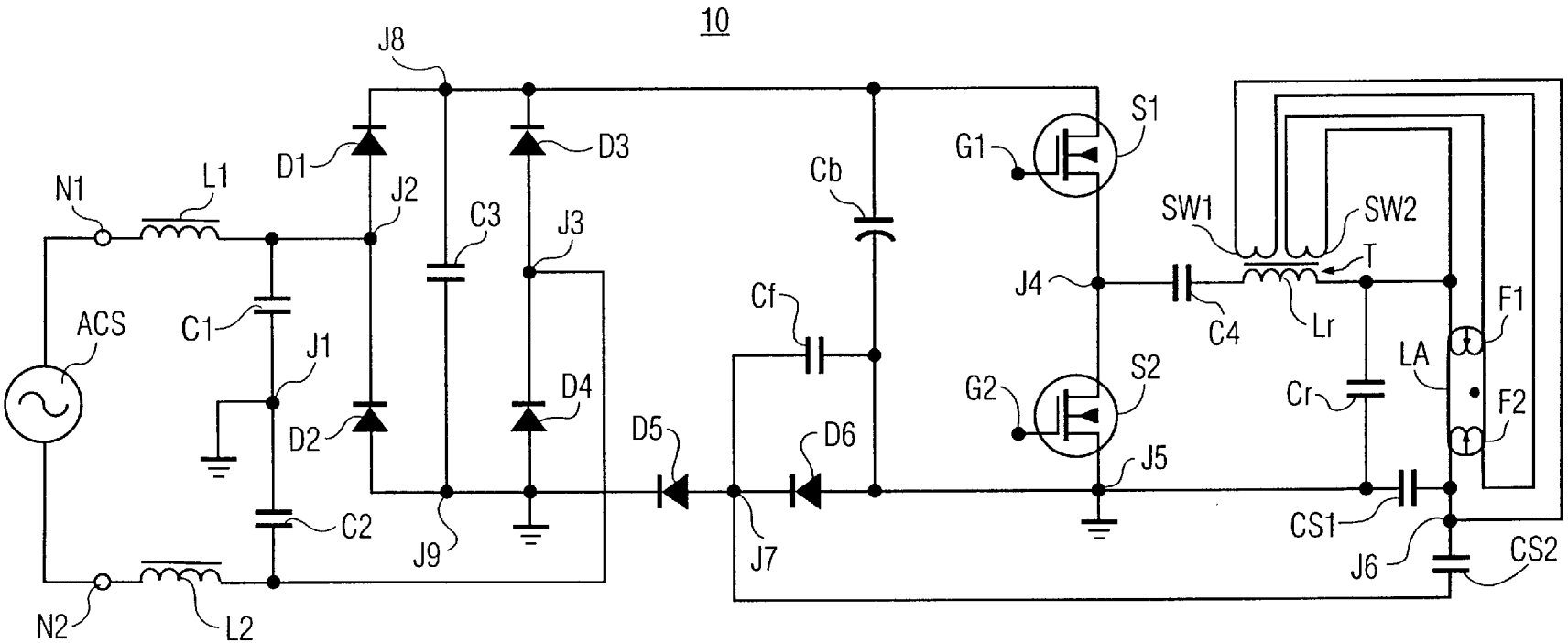
FIG. 1 is an electrical schematic of a ballast in accordance with a first embodiment of the invention.

As shown in FIG. 1, a mains sinusoidal AC voltage source ACS is connected to a ballast 10. Source ACS is connected to a pair of input nodes N1 and N2 of ballast 10. A pair of windings L1 and L2 are each connected at one end to input nodes N1 and N2, respectively. A serial combination of a pair of capacitors C1 and C2 are connected to the other ends of windings L1 and L2, respectively. A junction J1 joining together capacitors C1 and C2 are connected to ground. Windings L1 and L2 and capacitors C1 and C2 in combination form an electromagnetic filter (EMF). Harmonics generated by ballast 10 are removed by this filter and thereby prevented from being fed into source ACS.

The AC voltage from source ACS is applied through the filter to a full bridge rectifier formed by a plurality of diodes D1, D2, D3 and D4. The anode of diode D1 and the cathode of diode D2 are connected to a junction J2 joining capacitor C1 and winding L1 together. The anode of diode D3 and the cathode of diode D4 are connected to a junction J3 joining capacitor C2 and winding L2 together. One end of a capacitor C3 is connected to a junction J8 joining together the cathodes of diodes D1 and D3. The other end of capacitor C3 and a junction J9 joining together the anodes of diodes D2 and D4 are grounded. Capacitor C3 serves to filter high frequency components generated by ballast 10.

The full bridge rectifier rectifies the AC voltage which is applied to a serial combination of a buffer capacitor Cb and diodes D5 and D6. An electrolytic capacitor typically serves as buffer capacitor Cb.

A serial combination of switches S1 and S2, commonly referred to as totem-pole arrangement, are in parallel with buffer capacitor Cb. Switches S1 and S2 typically are power MOSFETs with gates G1 and G2, respectively, and are turned on and off by a driver (not shown) connected to gates G1 and G2. A DC blocking capacitor C4 is connected to the junction J4. A junction J5 (i.e. serving as a grounded reference node) connect switch S2, buffer capacitor Cb, diode D6, a resonant capacitor Cr and a reactor CS1 together. Capacitor C4 and switches S1 and S2 together form an inverter of the half-bridge type.

A serial combination of capacitor C4, a resonant inductor Lr and resonant capacitor Cr are connected in parallel across switch S2. Resonant inductor Lr and resonant capacitor Cr form a resonant circuit. The serial combination of a reactor CS1 and a lamp LA, such as a fluorescent lamp, is connected in parallel across resonant capacitor Cr. Lamp LA can be of the pre-heat or rapid-start type. Reactor CS1 can be either a capacitor (as shown in FIG. 1) or and an inductor. The resonant circuit is generally operated slightly above the resonant frequency of the resonant circuit once lamp LA is ignited and in a steady state mode of operation (i.e. in an inductive mode). The switching frequency of the inverter begins at a very high frequency (e.g. about 120K Hz) and is ramped downwardly toward the resonant frequency of the resonant circuit. Ignition of lamp LA occurs, for example, at about 70–80K Hz with steady state operation at about, for example, 45–50K Hz.

Preferably, resonant inductor Lr is a primary winding of a transformer T. A pair of secondary windings SW1 and SW2 are connected across and for heating a pair of filaments F1 and F2 of lamp LA, respectively. In an alternative embodiment of the invention, lamp LA can be of instant start-type whereby heating of filaments F1 and F2 through windings SW1 and SW2 can be eliminated.

A second reactor CS2 is connected between a junction J6 joining together reactor CS1 and lamp LA and a junction J7 joining together diodes D5 and D6. Reactor CS2 can be either a capacitor (as shown in FIG. 1) or an inductor. A feedback capacitor Cf is connected in parallel with diode D6. Reactor CS1 and feedback capacitor Cf together form a feedback path along which a portion of the high frequency current flowing through lamp LA is supplied to buffer capacitor Cb for boosting of the capacitor Cb voltage.

During operation of ballast 10, the rectified voltage supplied by the full bridge rectifier which is applied to buffer capacitor Cb is boosted by the high frequency current flowing through lamp LA along the feedback path. Ballast 10 avoids overboost voltage conditions by providing a feedback path which includes only a portion of the current flowing through lamp load LA. The amount of current being fedback for boosting the voltage across buffer capacitor Cb is far less than a conventional feedback scheme by splitting the current flowing through lamp load LA between the first reactor CS1 and second reactor CS2. Furthermore and until lamp LA is ignited, there is no feedback since there is no lamp current to be fedback, that is, there is no overboosting of the voltage across buffer capacitor Cb during ignition. Ignition of lamp LA therefore can be well controlled.

The values of reactors CS1 and CS2 are chosen based on lamp current and lamp voltage conditions. A smaller portion of lamp LA current can be designed to be fedback to buffer capacitor Cb for high lamp current conditions by increasing the impedance of the feedback path (e.g. making the impedance of reactor CS2 higher than the impedance of reactor CS1). A larger portion of lamp LA current can be designed to be fedback to buffer capacitor Cb for high lamp voltage conditions by decreasing the impedance of the feedback path (e.g. making the impedance of reactor CS1 higher than the impedance of reactor CS2).

Figure 2:
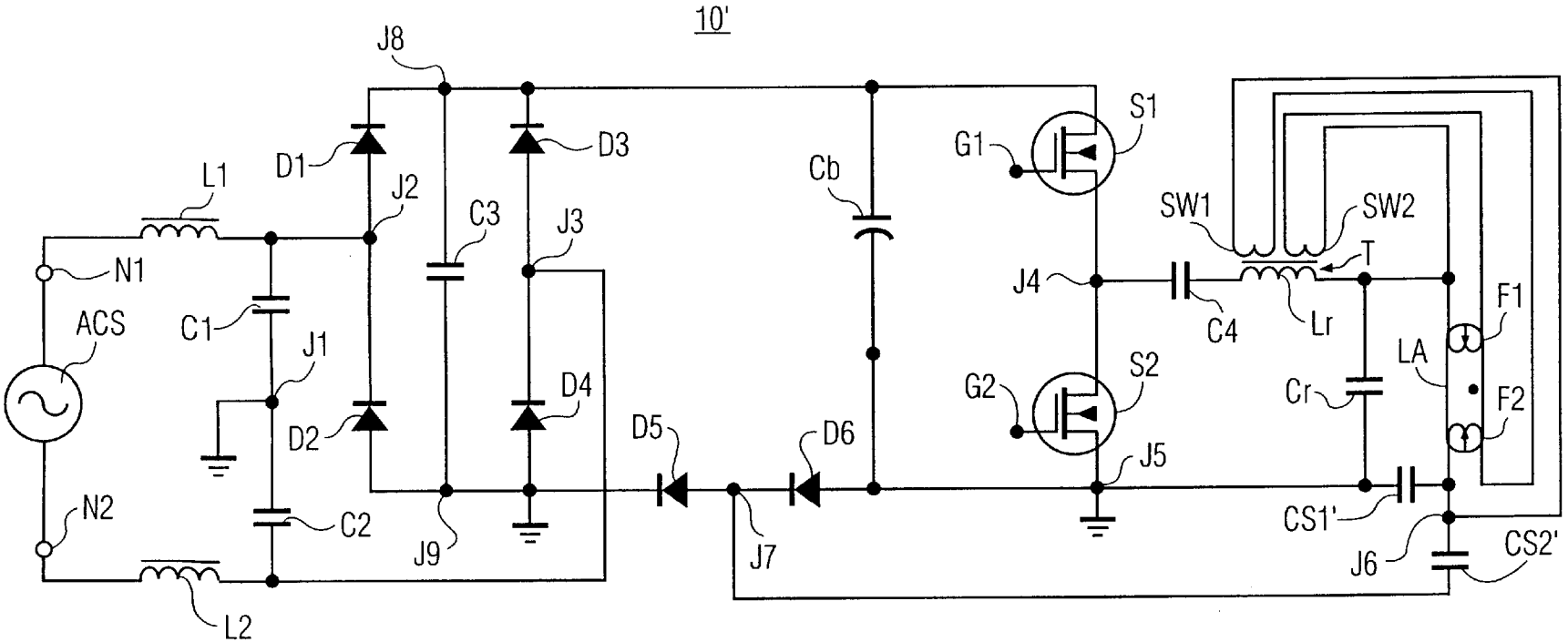
FIG. 2 is an electrical schematic of a ballast in accordance with a second embodiment of the invention.

Referring now to FIG. 2, in accordance with an alternative embodiment of the invention, a ballast 10' is constructed and operates in substantially the same manner as ballast 10. Those components which are the same in construction and operation within ballasts 10 and 10' have been identified by the same reference numerals/letters. Ballast 10' eliminates the need for feedback capacitor Cf by reflecting its affect on the feedback path through a change in the impedance of capacitors CS1 and CS2 as denoted by capacitors CS1' and CS2', respectively.

It will thus be seen that the objects set forth above and those made apparent from the preceding description are efficiently attained and since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

What we claim is:

1. A ballast, comprising:

a rectifier:

a buffer capacitor coupled across the output of the rectifier;

a pair of switches serially connected together having a switch junction therebetween and coupled across the buffer capacitor;

a first serial combination of a resonant inductor and a resonant capacitor together forming a resonant circuit and coupled between the switch junction and a reference node connecting the buffer capacitor and one of the pair of switches together;

a second serial combination of a lamp load and a first reactor connected in parallel with the resonant capacitor; and a second reactor for splitting current flowing through the lamp load between itself and the first reactor;

wherein a feedback path which includes the second additional reactor serves to boost the voltage across the buffer capacitor.

2. The ballast of claim 1, wherein the level of current flowing through the lamp load is substantially different from the level of current flowing through the resonant inductor.

3. The ballast of claim 1, wherein the feedback path is connected to a junction joining a pair of diodes which are coupled between the buffer capacitor and rectifier.

4. The ballast of claim 1, wherein the feedback path further includes a feedback capacitor.

5. The ballast of claim 3, wherein the feedback path further includes a feedback capacitor.

6. The ballast of claim 5, wherein the feedback capacitor is in parallel with one of the diodes.

7. A method for reducing the voltage applied to a buffer capacitor by a feedback path within a ballast circuit comprising the steps of:

supplying power through a half-bridge inverter to a resonant circuit whereby current flows through an inductor of a resonant circuit; and supplying along the feedback path less than all current flowing though a lamp load for charging the buffer capacitor;

wherein the lamp load is coupled across a portion of the resonant circuit.

8. The method of claim 7, wherein the level of current flowing through the resonant inductor is greater than the level of current flowing through the lamp load.

* * * * *